United States Patent [19]

Makino

[11] 4,164,924

[45] Aug. 21, 1979

[54] CENTRIFUGAL SPEED GOVERNOR FOR AN INTERNAL COMBUSTION ENGINE

[75] Inventor: Niro Makino, Toyota, Japan

[73] Assignee: Nippondenso Co., Ltd., Kariya, Japan

[21] Appl. No.: 858,816

[22] Filed: Dec. 8, 1977

[30] Foreign Application Priority Data

Dec. 16, 1976 [JP] Japan ..... 51-151702

[51] Int. Cl.[2] ..... F02D 1/04

[52] U.S. Cl. ..... 123/140 R

[58] Field of Search ..... 123/140 R, 140 J

[56] References Cited

U.S. PATENT DOCUMENTS

| | | | |
|---|---|---|---|
| 3,530,845 | 9/1970 | Staudt et al. | 123/140 R |
| 3,884,205 | 5/1975 | Staudt et al. | 123/140 R |
| 3,884,206 | 5/1975 | Ritter | 123/140 R |
| 3,946,715 | 3/1976 | Staudt | 123/140 R |

FOREIGN PATENT DOCUMENTS

| | | | |
|---|---|---|---|
| 49-5292 | 2/1974 | Japan | 123/140 R |

*Primary Examiner*—Charles J. Myhre
*Assistant Examiner*—Tony M. Argenbright
*Attorney, Agent, or Firm*—Cushman, Darby & Cushman

[57] ABSTRACT

A centrifugal speed governor for controlling fuel pump discharge into an internal combustion engine has a control shaft rotatable and axially movable by the rotation and radial movement of fly weights, respectively. The control shaft is operatively associated with a fuel pump control rack so that the pump discharge is varied with the increase of the engine speed. A maximum fuel lever having one end operative to limit movement of the control rack toward increasing the pump discharge in high speed engine operating range is operatively associated, at a point between the ends, with the control shaft and is pivotally connected at the other end to one end of a holding lever which is pivotally connected at the other end to the governor casing. The holding lever is operatively associated at a point between the ends with the control shaft so that the holding lever is held stationary in low speed engine operating range and also in compensation engine operating range between the low and high engine operating ranges but is rotated by the axial movement of the control shaft in the high speed engine operating range either to allow the control rack to be moved within a limited and reduced range toward increasing the pump discharge, or to move the control rack toward decreasing the pump discharge.

10 Claims, 2 Drawing Figures

CENTRIFUGAL SPEED GOVERNOR FOR AN INTERNAL COMBUSTION ENGINE

DESCRIPTION OF THE PRIOR ART

Japanese Utility Model Publication No. 47-5292 published Feb. 24, 1974 disclosed a BOSCH RQ type speed governor for a fuel-injection type internal combustion engine. The governor is operatively associated with a fuel injection pump and has fly weights mounted on a shaft which is rotated in timed relationship with the engine revolution. The fly weights are radially outwardly moved against idle springs as the engine speed is increased. The fly weights are operatively connected to a control shaft so that the radial movement of the fly weights is converted into an axial movement of the control shaft. The pump has a control rack operative to control the fuel pump discharge. The control rack is operatively connected by a floating lever to the control shaft so that the fuel pump discharge is varied when the engine speed is varied.

The governor is provided with an "Angleich device" (compensating device) which is automatically operative to hold down or suppress undue increase of the fuel pump discharge which would otherwise occur with the increase of the engine speed. The operation of the compensating device is made effective in the range of the engine operation between the low and high speed engine operation ranges. The range of the engine speed where the operation of the compensating device is made effective will be called herein "compensation engine operating range" or the like. The compensating device includes compensation springs operative to yieldably act against the radially outward movement of the fly weights in the compensation engine operating range.

A steering lever is pivotally connected at one end to the floating lever between the ends thereof. The point of pivotal connection of the floating lever to the steering lever is movable within a limited range along the length of the floating lever. The other end of the steering lever is pivotally connected to a shaft which is secured to an adjusting lever for rotation thereby. The steering and adjusting levers are normally urged to a stable position by a biasing spring. When the steering lever is at a position angularly displaced away from the stable position, the biasing spring acts to return the steering lever to the stable position. The biasing spring also acts on the floating lever through the steering lever.

The governor also includes a maximum fuel lever having one end operatively associated with the pump discharge control rack and is pivotable about a fulcrum adjacent to the other end. The maximum fuel lever is operatively connected between the ends to the control shaft so that the lever is rotated about the fulcrum when the engine speed is increased and the control shaft is moved axially thereof. In the low speed engine operating range, the maximum fuel lever limits the movement of the control rack toward increasing the fuel pump discharge, while the steering lever is held at a position angularly displaced from its stable position. In the compensation engine operating range wherein the maximum fuel lever is rotated by the axial movement of the control shaft, the steering lever is rotated by the biasing spring toward the stable position to rotate the floating lever. The rotation of the maximum fuel lever due to the control shaft axial movement permits the control rack to be moved by the rotation of the floating lever toward increasing the fuel pump discharge. When the steering lever is returned to its stable position, the governor performs a high speed control wherein the control rack is moved toward decreasing the fuel pump discharge according to a further axial movement of the control shaft and independently of the maximum fuel lever.

With the speed governor described above, the force of the biasing spring does not act on the floating lever after the steering lever has been returned to the stable position simultaneously with the rise of the engine speed beyond the compensation engine operating range. The governor, therefore, provides a reliable high speed control characteristic. This is also true with the case where the arrangement is such that the steering lever is returned to the stable position at a point between the beginning and the end of the compensation engine operating range. The adjusting lever has conventionally been set relative to the steering lever so that the above control characteristic can be obtained.

Practically, however, this setting has not always been easy. If, in the prior art governor, the setting was erroneously or roughly made so that the steering lever could not be returned to its stable position even after the end of the compensation engine operating range, the maximum fuel lever was pivotally moved, even during the high speed control, in the same direction and at the same rate as in the compensation engine operating range with the result that the control rack was moved a large distance toward increasing the fuel pump discharge, which extraordinarily raised the engine speed with resultant possibility of engine breakage or destruction.

SUMMARY OF THE INVENTION

It is an object of the present invention to eliminate the disadvantage discussed above.

The speed control governor according to the present invention includes a holding lever which is pivotally connected at one end to one end of the maximum fuel lever and which is held stationary during low-speed and compensation engine operations and pivotally moved or swivelled about a point adjacent to the other end of the holding lever in accordance with the axial movement of the control shaft whereby the control rack is either allowed to move within a limited and reduced range toward increasing the fuel injection, or moved toward decreasing the fuel injection.

The above and other objects, features and advantages of the present invention will be made more apparent by the following description with reference to the accompanying drawings.

DESCRIPTION OF A PREFERRED EMBODIMENT

Figure 1:
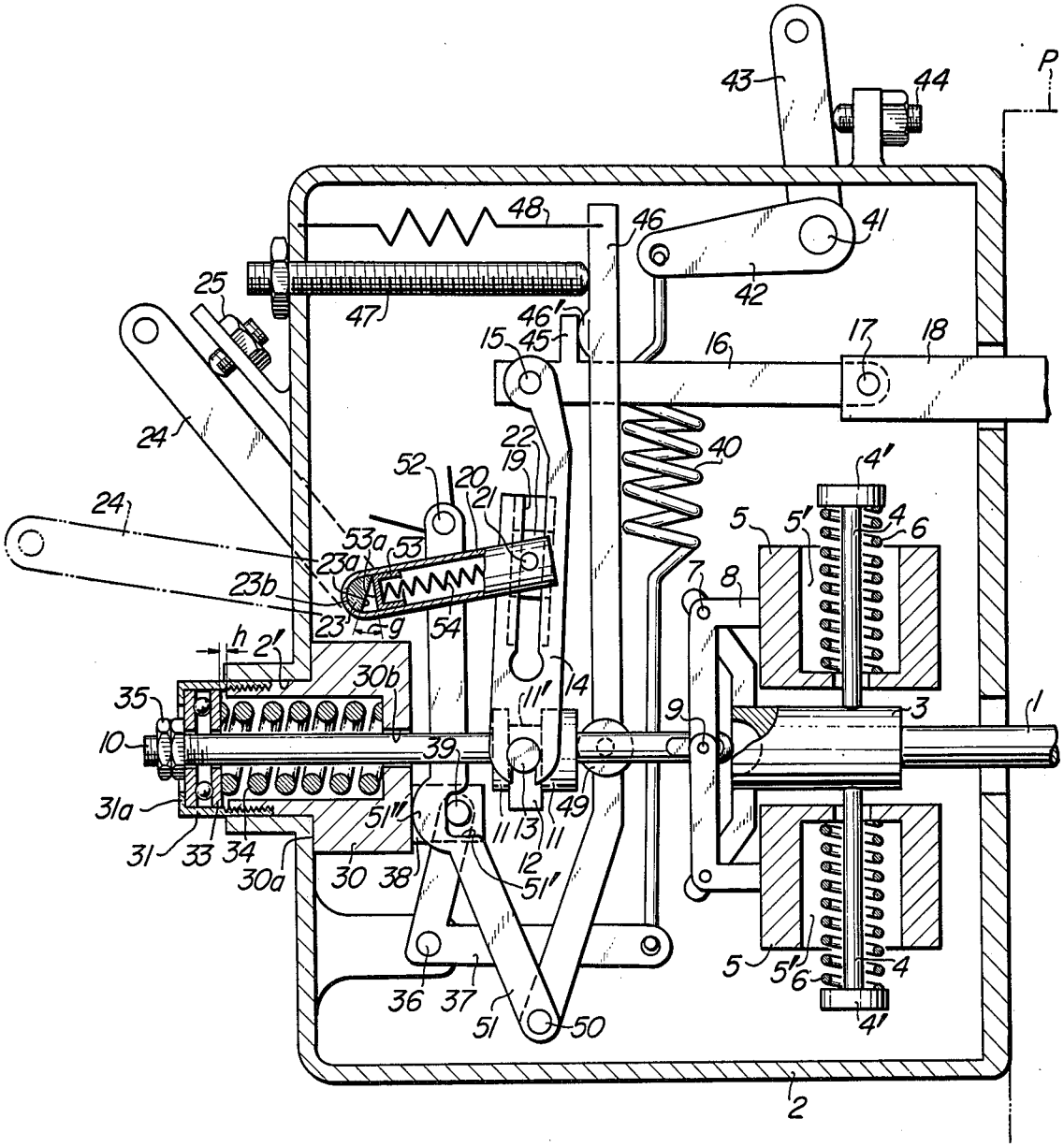
FIG. 1 is a schematic partially sectional side elevation of an embodiment of the speed governor according to the present invention.

Referring to FIG. 1, a fuel injection pump P is shown by broken lines and has a cam shaft 1 which is rotated in timed relationship to the engine revolution and has an end extending into a governor casing 2. A weight holder 3 is secured to the end of the cam shaft 1. Rods 4 having heads 4' respectively are secured to and extend from the peripheral surface of the weight holder 3 radially outwardly of the axis of the cam shaft 1. Fly weights 5 are movably mounted on the rods 4, respectively. Each fly weight 5 is provided therein with a radially outwardly open recess 5'. An idle spring 6 in the form of a compression coil spring extends between the bottom of the recess 5' in each fly weight 5 and the head 4' of the associated rod 4 to radially inwardly bias the fly weight toward the weight holder 3. The fly weights 5 are moved radially outwardly against the idle springs 6 by the centrifugal force produced by the rotation of the cam shaft 1.

Two-armed levers in the form of bell cranks 8 are pivotally mounted by pins 7 to the weight holder 3 and secured at the radially outer ends to the fly weights 5. The other or inner ends of the bell cranks 8 are operatively connected by a pin 9 to one end of a control shaft 10 generally coaxial with the cam shaft 1. The bell cranks 8 and the control shaft 10 are disposed on the side of the fly weights 5 remote from the fuel injection pump P. The bell cranks 8 are operative to convert radial movement of the fly weights 5 into axial movement of the control shaft 10. More particularly, the radially outward movement of the fly weights 5 due to increase in the centrifugal force is converted into movement of the shaft 10 toward the pump P, i.e., rightwards as viewed in FIG. 1, and vice versa. The control shaft 10 extends through the governor casing 2 and has the other end extending outwardly from the casing 2, as will be described in more detail later.

A pair of axially spaced annular lands 11 are provided on the control shaft 10 between the ends thereof and define an annular groove 11' in which a slide 12 having a pin 13 thereon is slidably received. A floating lever 14 has a lower end operatively engaged with the pin 13. The upper end of the floating lever 14 is operatively connected by a pin 15 to one end of a shackle 16 which in turn is operatively connected at the other end and by a pin 17 to the free end of a control rack 18 of the fuel injection pump P, the shackle 16 and the control rack 18 being generally parallel to the cam shaft 1 and the control shaft 10.

A slot 19 is formed in the floating lever 14 between the ends thereof and extends longitudinally of the lever 14. A slide 22 is slidably received in the slot 19 and has a pin 21 by which the slide 22 is operatively or angularly movably connected to one end of a steering lever 20 the other end of which is pivotally connected to a shaft 23 which is rotatably supported by the casing 2 and fixed to a first adjusting lever 24. The floating lever 14 is adapted to be rotated in principle about the pin 21 on the slide 22 by the axial movement of the control shaft 10. The rotation of the floating lever 14 is transmitted through the shackle 16 to the control rack 18 to control the fuel discharge of the fuel pump P. On the other hand, the operation of the first adjusting lever 24 causes the steering lever 20 to be rotated about the axis of the shaft 23, so that the slide 22 is slidably moved along the slot 19 in the floating lever 14. This also causes the floating lever 14 to be rotated or angularly moved about the pin 13 to thereby move the control rack 18 in its longitudinal direction. The movement of the slide 22 along the slot 19 displaces the fulcrum of the floating lever 14, so that the leverage is varied with resultant change of the ratio of the longitudinal displacement of the control rack 18 to the axial displacement of the control shaft 10. The first adjusting lever 24 is rotatable about the axis of the shaft 23 between a full load position shown by the solid line in FIG. 1 and an idle position shown by the broken line. The full load position is determined by a stop 25 in the form of a bolt screwed into a part of the casing 2.

In the wall of the casing 2 adjacent to the outer end of the control shaft 10 (and thus, remote from the fuel pump P), there is formed an opening 2' coaxial with the control shaft 10. The opening 2' receives therein a compensation device which includes a generally cup-shaped member 30 having a first or outer portion slidably received in the opening 2' and a second or inner portion having an outer diameter larger than that of the first portion to provide an annular shoulder **30*a* which is adapted to be engaged by the part of the casing 2 around the opening 2' to thereby limit the axially outward movement of the member 30. A central opening 30*b* is formed in the bottom of the cup-shaped member 30, the bottom being disposed inside the casing 2. A sleeve member 31 is screwed over the first portion of the cup-shaped member 30. The sleeve member 31 has its outer diameter substantially the same as that of the first portion of the member 30 so that, when the cup-shaped member 30 is moved inwardly, the sleeve 31 is also moved together with the member 30 through the opening 2'. A bearing 33 is placed in the sleeve 31 and retained therein by an annular flange 31*a* extending radially inwardly from the outer end of the sleeve 31. The bearing 33, however, is axially rightwardly movable a distance h until the bearing is engaged by the annular end face of the first or outer portion of the cup-shaped member 30. A compensating spring 34 in the form of a compression coil spring is disposed within the assembly of the member 30 and the sleeve 31 and extends between the bottom of the member 30 and the bearing 33 normally to urge the latter against the flange 31*a*. The control shaft 10 extends rotatably and axially movably through the opening 30*b* in the bottom of the member 30, through the compensating spring 34 and through the bearing 33. Nuts 35 are screwed over the externally threaded outer end of the control shaft 10 so that the outer end face of the bearing 33 is engaged by one of the nuts 35. With this arrangement, when the control shaft 10 is axially moved towards the fuel injection pump P and after the movement has exceeded a predetermined value, the compensating spring 34 will then yieldably resist against the movement of the shaft 10 over a further distance h. The range of the engine operation speed wherein the control shaft is rightwardly moved the distance h against the spring 34 and relative to the cup-shaped member 30** is called "compensation engine operating range," as defined previously.

A pin 36 on the casing 2 rotatably supports the intermediate point of a two-armed tension lever in the form of a bell crank 37 having one end pivotally connected by a pin 39 to an abutment member 38 which is in abutment contact with the bottom wall of the cup-shaped member 30. The other end of the tension lever 37 is connected to one end of a main spring 40 which is in the form of a tension spring and tends to rotate the tension lever 37 in counterclockwise direction about the pin 36 so that the abutment member 38 is resiliently urged against the inner end (bottom wall) of the cup-shaped member 30. When the engine is accelerated beyond the compensation engine operating range up to a high speed engine operating range, the bearing 33 is moved into engagement with the annular outer end face of the cup-shaped member 30 due to the rightward movement of the control shaft 10 and, thereafter, the control shaft 10 is further moved together with the bearing 33 and thus with the cup-shaped member 30 due to increased centrifugal force produced by the fly weights 5. The main spring 40 is adapted to resist against the said further movement of the control shaft 10.

The upper or the other end of the main spring 40 can be secured to a stationary part of the casing 2 but, in the illustrated embodiment of the invention, is operatively connected to one end of an arm 42 which is secured at the other end to a shaft 41 rotatably mounted on the upper part of the casing 2. The shaft 41 has an end extending outwardly from the casing 2. A second adjusting lever 43 is secured to this end of the shaft 41 so that the tension in the main spring 40 can be varied by operating the second adjusting lever 43 to rotate the arm 42 about the axis of the shaft 41. The lever 43 can be rotated to a full-open position which is determined by a stop 44 in the form of a bolt screwed into a part of the casing 2.

The shackle 16 is provided thereon with a projection 45 extending transversely therefrom. A maximum fuel lever 46 extends generally transversely across the control shaft 10 and the shackle 16 and has an abutment portion 46' positioned slightly downwardly of the upper end of the lever 46 and adapted to be engaged with the surface of the projection 45 directed toward the fuel pump P to limit the movement of the shackle 16 and thus of the control rack 18 to the right, i.e., toward increasing the fuel pump discharge. A stop 47 in the form of a bolt screwed through the side of the casing 2 remote from the pump P and extending into the casing a substantial distance in substantially parallel relationship to the shackle 16 has an inner end adapted to be engaged by the part of the maximum fuel lever 46 between the upper end and the abutment portion 46' thereof. A return spring 48 extends between the casing 2 and the upper end of the maximum fuel lever 46 and in substantially parallel relationship with the stop bolt 47 to resiliently urge the lever 46 against the inner end of the stop bolt 47.

The lower portion of the maximum fuel lever 46 is bent or curved leftwards toward the compensating device and has the bottom end pivotally connected by a pin 50 to the bottom end of a holding lever 51 to be described later. A roller 49 is rotatably mounted on the maximum fuel lever 46 such that the roller can be engaged by the right end face of the annular land 11 on the control shaft 10. The arrangement is such that the right end face of the annular land 11 on the shaft 10 is moved into contact with the roller 49 when the inner nut 35 on the outer end of the control shaft 10 is moved into engagement with the bearing 33 (i.e., at the beginning of the compensation engine operating range). If the control shaft 10 is further moved toward the pump P after the roller 49 on the maximum fuel lever 46 has been engaged by the annular land 11 on the control shaft 10, the land 11 forces the roller 49 towards the pump P so that the maximum fuel lever 46 is rotated clockwise about the pin 50 against the tension in the return spring 48.

The holding lever 51 extends generally transversely of the control shaft 10 and between the cup-shaped member 30 and the pin 39 and has an upper end positioned above the control shaft 10 and pivotally connected to the casing 2 by a pin 52. The upper part of the lever 51 is generally parallel to the maximum fuel lever 46, while the lower part of the lever 51 extends from the upper part thereof downwardly rightwardly to the pin 50. At the junction between the upper and lower portions of the holding lever 51, a notch 51' is formed in the side or longitudinal edge of the lever adjacent to the fuel pump P to loosely receive therein the pin 39 on the abutment member 38, while a round or arcuate projection 51'' is provided on the opposite longitudinal edge of the lever 51 at a point aligned with the notch 51' to thereby facilitate smooth sliding movement of the projection 51'' on the inner end face of the cup-shaped member 30. Thus, when the member 30 is moved rightwards due to the movement of the control shaft 10 toward the pump P, the member 30 causes the holding lever 51 to rotate in counterclockwise direction about the pin 52 so that the pin 50 is moved toward the pump P.

The shaft 23 fixed to the first adjusting lever 24 includes a portion having a substantially semicircular cross-section providing a flat face **23*a* and a round or arcuate face 23*b*. The steering lever 20 is made of a generally tubular hollow member and rotatably connected at one end to the shaft 23 transversely thereof. A lateral hole is formed in and extends through the steering lever 20 and has a round inner peripheral surface in slidable engagement with the arcuate face 23*b* of the shaft 23. A cup 53 is slidably disposed in the steering lever 20 and has a flat end face 53*a* disposed in generally opposite relationship to the flat face 23*a* of the shaft 23. A biasing spring 54 in the form of a compression coil spring is disposed in the steering lever 20 to resiliently urge the cup 53 against the flat face 23*a* so that the steering lever 20 is normally held relative to the shaft 23 in a stable position in which the end face 53*a* of the cup 53 is in intimate face-to-face engagement with the flat face 23*a* of the shaft 23. During the engine operation at least in low speed and compensation engine operating ranges, however, if the first adjusting lever 24 is placed in the full load position shown by the solid line in FIG. 1, the rotation of the floating lever 14 is limited by the actions of the maximum fuel lever 46 due to the return spring 48, of the idle springs 6 and of the compensating spring 34 with a result that the steering lever 20 is held in a position in which the lever 20 is rotated from the stable position counterclockwise relative to the shaft 23 and thus to the first adjusting lever 24, as shown in FIG. 1. In this position of the steering lever 20, the end face 53*a* of the cup 53 is positioned at an angle g relative to the flat face 23*a* of the shaft 23 so that the cup 53 presses the biasing spring 54 to a shortened length and thus the biasing spring 54 exhibits a resilient biasing force tending to rotate the steering lever 20 about the shaft 23** in clockwise direction toward the stable position.

The above-described speed governor is capable of performing both maximum-minimum speed control and all speed control. The governor operation during the maximum-minimum speed control will be described first. In this case, the second adjusting lever 43 will be held in the full-open position shown in FIG. 1. In starting the engine, the first adjusting lever 24 will then be rotated toward the stop 25 so as to be set at the full-load position. At the initial or first stage of the rotational movement of the first adjusting lever 24, the end face **53*a* of the cup 53 in the steering lever 20 is held by the biasing spring 54 in intimate face-to-face contact with the flat face 23*a* of the shaft 23 which is secured to the first adjusting lever 24, so that the steering lever 20 is rotated clockwise together with the first adjusting lever 24, with a result that the slide 22 is moved downwardly along the slot 19 in the floating lever 14 to rotate the same in clockwise direction about the pin 13 thereby for causing the control rack 18 rightwards, i.e., toward increasing the fuel pump discharge until the projection 45 on the shackle 16 is engaged by the abutment portion 46' of the maximum fuel lever 46 and the movement of the control rack 18 and the clockwise rotation of the steering lever 20 are stopped. At this stage of the governor operation, since no centrifugal force acts on the fly weights 5, the control shaft 10 is located in a position which is displaced by the idle springs 6 leftwards from the position shown. Accordingly, the floating lever 14 is in a position angularly displaced clockwise from the position shown, the slide 22 is in a position slightly above the position shown and the steering lever 20 is in a position angularly displaced counterclockwise from the position shown. A further movement of the first adjusting lever 24 toward the stop 25 after the movement of the steering lever 20 is stopped by the engagement of the projection 45 on the shackle 16 with the maximum fuel lever 46 would tend to move the lower end of the foating lever 14 toward the pump P and thus rotate the bell cranks 8 to move the fly weights 5 radially outwardly against the idle springs 6. However, because the force of the biasing spring 54 in the steering lever 20 is smaller than that of the idle springs 6, the further movement of the first adjusting lever 24 simply causes the shaft 23 to be rotated relative to the cup member 53 in the steering lever 20 so that the cup member 53 is shifted by the cam action of the flat face 23***a* of the shaft 23 to compress the biasing spring 54 until the lever 24 is engaged by the stop 25.

When the engine is started to rotate the cam shaft 1 and the fly weights 5 and, as the centrifugal force of the fly weights is increased, the fly weights are moved radially outwardly against the idle springs 6. This movement is transmitted through the bell cranks 8 to the control shaft 10 so that the latter is moved axially towards the pump P (i.e., rightwards in FIG. 1). The movement of the control shaft 10 is continued until the roller 49 on the maximum fuel lever 46 is engaged by the right end face of the annular land 11 on the shaft 10 and, simultaneously, the inner nut 35 on the outer end of the shaft 10 is moved into engagement with the bearing 33, as shown in FIG. 1. A further rightward movement of the control shaft 10 is stopped or suppressed for a while by the compensating spring 34 and the return spring 48. The described rightward movement of the control shaft 10 moves the lower end of the floating lever 14 rightwards, merely with the results that the slide 22 is downwardly moved along the slot 19 in the floating lever 14 by the biasing force of the spring 54 and that the steering lever 20 is rotated clockwise about the shaft 23 so that the angular distance between the flat face 23*a* of the shaft 23 and the end face 53*a* of the cup member 53 is reduced to an angle g. The floating lever 14 is rotated about the pin 15 in counterclockwise direction. Thus, the control rack 18 is held stationary.

Figure 2:
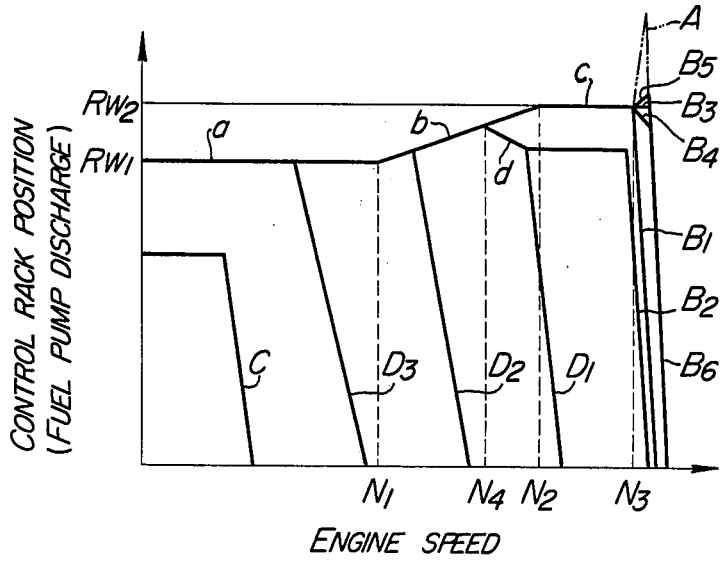
FIG. 2 is a graphical illustration of the operating characteristics of the governor shown in FIG. 1.

The described movement of the control rack 18 during the engine operation in the low speed range is represented by a line a in FIG. 2. Stated in other words, because the rightward movement of the control rack 18 is limited by the maximum fuel lever 46 in this range of engine operation, the control rack 18 is held in the position shown in FIG. 1 and thus the fuel pump discharge is kept substantially constant by the time the engine speed is raised to $N_1$ in FIG. 2.

When the speed of the engine (and thus of the cam shaft 1) is increased to the compensation engine operating range in which the engine speed exceeds $N_1$, the centrifugal force of the fly weights 5 overcomes the resistance provided by the compensating spring 34 and the return spring 48. Thus, as the engine speed is increased, the control shaft 10 is moved rightwards over the distance h against the compensating spring 34 until the bearing 33 is engaged by the annular outer end face of the cup-shaped member 30 of the compensating device. Because, at this time, the annular land 11 on the control shaft 10 is in rolling contact with the roller 49 on the maximum fuel lever 46, the rightward movement of the control shaft 10 rotates the maximum fuel lever 46 clockwise about the pin 50 and against the return spring 48 to move the upper end portion of the lever 46 away from the stop 47. Because the biasing spring 54 in the steering lever 20 functions to rotate the floating lever 14 clockwise about the pin 13 and because the upper end portion of the maximum fuel lever 46 is now moved away from the stop 47 to permit rightward movement of the shackle 16, the floating lever 14 is rotated clockwise and causes the shackle 16 and the control rack 18 to move rightwards (toward increasing fuel injection) following the rightward movement of the maximum fuel lever 46 about the pin 50. During the clockwise rotation of the floating lever 14, the slide 22 is moved downwardly along the slot 19 in the lever 14, the cup 53 in the steering lever 20 is urged by the biasing spring 54 to decrease the angle g and the steering lever 20 is rotated clockwise about the shaft 23 toward the stable position. In the compensation engine operating range, therefore, the control rack 18 is moved toward increasing the fuel pump discharge as the engine speed is increased. This will be discussed with reference to FIG. 2. When the engine speed exceeds $N_1$, the control rack 18 is moved from a position $RW_1$ to a position $RW_2$, as shown by a line b, to increase the fuel pump discharge and thus the engine speed. When the engine speed reaches $N_2$, the bearing 33 has just been engaged by the annular outer end face of the cup-shaped member 30 of the compensating device. The compensation engine operating range is terminated at this moment and any further rightward movement of the control shaft 10 is also resisted by the main spring 40. The further rightward movement of the control shaft 10 is momentarily interrupted and the shaft 10 is held stationary until the rightward force acting on the shaft 10 overcomes the initial load applied by the main spring 40. Namely, the control rack 18 is kept at the position $RW_2$ to keep the fuel pump discharge constant as shown by a line c in FIG. 2 until the engine speed is increased to $N_3$.

In the high speed engine operating range wherein the engine speed is further increased beyond $N_3$ and the centrifugal force of the fly weights 5 overcomes the tension in the main spring 40, the control shaft 10 is further moved rightwards together with the cup-shaped member 30 as the engine speed is increased to rotate the tension lever 37 clockwise about the pin 36. Thus, the roller 49 on the maximum fuel lever 46 is urged rightwards by the annular land 11 on the control shaft 10 while the holding lever 51 is rotated in counterclockwise direction about the pin 52 by the cup-shaped member 30, with a result that the pin 50 at the bottom end of the lever 46 is moved rightwards. The abutment portion 46' of the maximum fuel lever 46 will be moved either leftwards or rightwards or held stationary dependent on the relationship between the rightward movements of the roller 49 and the pin 50. The operation of the governor during the high speed control will vary with different settings of the angle g between the flat face 23a of the shaft 23 and the end face 53a of the cup 53 in the steering lever 20, as will be described in detail hereunder:

(i) In the case where the arrangement is such that the end face 53a of the cup 53 is brought into intimate face-to-face contact with the flat face 23a of the shaft 23 at the same time when the compensation engine operating range is terminated (i.e., when the bearing 33 is moved into contact with the cup-shaped member 30), the biasing spring 54 no longer functions to rotate the steering lever 20 during the high speed control. Thus, the rightward movement of the control shaft 10 will rotate the floating lever 14 about the pin 21 in counterclockwise direction, so that the shackle 16 and the control rack 18 will be moved leftwards, as shown by a line $B_1$ in FIG. 2, to decrease the fuel pump discharge. At this time, the upper end of the maximum fuel lever 46 will be moved leftwards. In the case where the leftward movement of the upper end of the maximum fuel lever 46 is greater than the leftward movement of the shackle 16 and the control rack 18 caused by the rightward movement of the shaft 10 through the floating lever 14, the movement of the control rack 18 toward decreasing the fuel pump discharge will be increased or amplified by the leftward movement of the maximum fuel lever upper end. If, however, the holding lever 51 and the maximum fuel lever 46 are not arranged such that the lever 46 functions in the described manner, the leftward movement of the maximum fuel lever upper end will not be concerned with the leftward movement of the control rack 18.

(ii) In the case where the arrangement is such that the flat face 23a of the shaft 23 is still angularly displaced from the end face 53a of the cup 53 after the compensating engine operating range has been terminated, the biasing spring 54 is still operative during the high speed control of the governor to resiliently urge the floating lever 14 so that the lever 14 is either rotated or laterally moved to cause the shackle 16 to follow the movement of the upper end portion of the maximum fuel lever 46. More particularly, the control rack 18 will not be moved (as represented by a line $B_3$ in FIG. 2) and the floating lever 14 will be rotated in counterclockwise direction about the pin 15 by the movement of the control shaft 10 with resultant gradual decrease of the angle g toward zero (0) degree in the case where the rightward displacement of the pin 50 caused by the counterclockwise rotation of the holding lever 51 about the pin 52 is consistent with the displacement of the pin 50 caused by that counterclockwise rotation of the maximum fuel lever 46 about the point of engagement (46') of the lever 46 with the projection 45 of the shackle 16 which is caused by the rightward movement of the roller 49 due to the rightward movement of the annular land 11 (in this case, the point of engagement 46' of the maximum fuel lever 46 with the projection 45 of the shackle 16 is not moved). In the case where the displacement of the pin 50 at the bottom end of the maximum fuel lever 46 is greater than that in the above-discussed case and thus the projection 45 of the shackle 16 is moved leftwards, the control rack 18 will be correspondingly moved leftwards (toward decreasing the fuel pump discharge), as represented by a line $B_4$ in FIG. 2. Also in this case, the floating lever 14 will be rotated in counterclockwise direction about the pin 15 with resultant gradual decrease of the angle g toward zero (0) degree. In a further case where the upper end of the maximum fuel lever 46 is moved rightwards, the control rack 18 will be moved rightwards (toward increasing the fuel pump discharge), as represented by a line $B_5$ in FIG. 2, until the angle g is decreased to zero (0) degree. In this case, however, the displacement of the upper end portion of the maximum fuel lever 46 and thus the rightward displacement of the control rack 18 are smaller than that in the case where the pin 50 at the bottom end of the maximum fuel lever 46 is retained at a fixed point. After the angle g has become zero (0) degree, the control rack 18 will be moved leftward (toward decreasing the fuel pump discharge), as represented by a line $B_6$ in FIG. 2, in a manner similar to the case (i) discussed previously. The movement of the upper end of the maximum fuel lever 46 depends upon the choice of the leverage of the lever 46 and the leverage of the holding lever 51.

(iii) In the case where the arrangement is such that the angle g become zero (0) degree at the midpoint of the compensating engine operating range (i.e., between engine speed $N_1$ and $N_2$), the floating lever 14 will begin to rotate in counterclockwise direction in accordance with the movement of the control shaft 10 from the time when the angle g becomes zero degree, to thereby move the control rack 18 toward decreasing the fuel pump discharge (as represented by a line d in FIG. 2). During a high speed control, the governor operates in a manner similar to the case (i), as represented by a line $B_2$ in FIG. 2.

When the first adjusting lever 24 is rotated in counterclockwise direction to the idle position shown by the broken line and held in this position, the steering lever 20 is held in its stable position in which the flat face 23a of the shaft 23 is in intimate face-to-face contact with the end face 53a of the cup 53. The projection 45 of the shackle 16 is not in contact with the maximum fuel lever 46. The control rack 18, therefore, can be moved independently of the maximum fuel lever 46 toward decrease of the fuel pump discharge to thereby control the idle speed of the engine, as represented by a line C in FIG. 2.

As will be seen from the foregoing description, while the governor according to the present invention has a characteristic of increasing the fuel pump discharge in the compensating engine operating range, the governor is operative during high speed control either to supress or minimize the increase of the fuel pump discharge or, to the contrary, positively decrease the fuel pump discharge. Accordingly, the governor provides an optimum high speed control performance and at least eliminates the problem of engine breakage which occured with the prior art governor.

In all-speed control, the first adjusting lever 24 will be set at the full load position shown by the solid line in FIG. 1. The second adjusting lever 43 will then be operated and rotated together with the shaft 41 to vary the tension in the main spring 40 applied to the tension lever 37 and thus to the cup-shaped member 30 with a result that the governor provides control characteristics represented by lines $D_1$, $D_2$ and $D_3$ (in this case, the governor is arranged such that the angle g is reduced to zero (0) degree before the compensation engine operating range is terminated).

The speed governor of the described and illustrated embodiment of the invention is designed to provide both maximum-minimum speed control performance and all-speed control performance. The governor of the invention, however, may provide only the maximum-minimum control performance. In this case, the compensating spring and the main spring may be so installed as to directly act on the fly weights 5 like the idle springs 6 as in the manner shown, for example, in Japanese Utility Model Publication No. 47-5292 referred to above.

As described, the speed governor according to the present invention is operative to increase the fuel pump discharge at a controlled and compensated rate in the compensation engine operating range and to provide a reilable high-speed control characteristic and, thus, contributes to an optimum engine operation.

What is claimed is:

1. A centrifugal speed governor for an internal combustion engine of the type that has a fuel supply system including a fuel injection pump having a control rack movable to control the fuel pump discharge, said governor comprising fly weights rotatable about a first axis in timed relationship with the engine revolution and movable radially outwardly of said first axis with the increase in the centrifugal force produced by the rotation of said fly weights, a control shaft operatively connected to said fly weights and axially movable by the radial movement of said fly weights, a floating lever operatively connecting said control shaft with said control rack of said fuel injection pump, idle spring means yieldably acting in at least an idle operating range against the centrifugal force produced by the rotation of said fly weights, main spring means yieldably acting against said centrifugal force in a high speed engine operating range, compensating means operative to suppress undue increase of the fuel pump discharge which would otherwise occur with the increase of the engine speed, said compensating means including compensating spring means yieldably acting against said centrifugal force in a compensation engine operating range between said idle and high speed engine operating ranges, an adjusting lever rotatable about a second axis between idle and full load positions, a steering lever having one end operatively connected to said floating lever at a point between the ends thereof, the other end of said steering lever being operatively connected to said adjusting lever for relative angular movement, biasing spring means operatively associated with said steering lever and operable to yieldably hold said steering lever at a predetermined stable position relative to said adjusting lever and, when said steering lever is angularly displaced from said stable position, to return said steering lever to said stable position, the point of connection between said steering and floating levers being movable substantially longitudinally of said floating lever to provide the same with a variable fulcrum about which said floating lever is rotated by the axial movement of said control shaft to move said control rack, a maximum fuel lever operative to limit the movement of said control rack toward increasing the fuel pump discharge, said maximum fuel lever being rotatable about a pivot point adjacent to one end thereof and operatively associated with said control rack at a second point remote from said pivot point, said maximum fuel lever having a third point operatively associated with said control shaft so that said maximum fuel lever is rotated about said pivot point particularly in said compensation engine operating range to allow said control rack to follow the rotational movement of said maximum fuel lever and thus move toward increasing the fuel pump discharge so far as said biasing spring means biases said steering lever to return to said stable position, the arrangement being such that when said adjusting lever is placed at said full load position said steering lever is adapted to be held at a position angularly displaced from said stable position at the beginning of said compensation engine operating range and such that, when said maximum fuel lever is rotated about said pivot point by the axial movement of said control shaft, said steering lever is rotated about said other end thereof to move said point of connection between said steering and floating levers longitudinally of said floating lever so that said control rack is caused to follow the movement of said maximum fuel lever and move toward increasing the fuel pump discharge, and a holding lever pivotable about a point adjacent to one end thereof and having a first part operatively associated with said control shaft so that said holding lever is rotated about said one end by the axial movement of said control shaft in said high speed engine opeating range, said holding lever having a second part operatively associated with said maximum fuel lever at said pivot point so that, when said holding lever is rotated by said control shaft in said high speed engine operating range, said pivot point of said maximum fuel lever is moved in the same direction as the movement of said second part of said holding lever.

2. A centrifugal speed governor according to claim 1, further including an additional adjusting lever operatable to adjust the initial load applied by said main spring.

3. A centrifugal speed governor according to claim 1, in which said one end of said maximum fuel lever is pivotally connected to said second part of said holding lever.

4. A centrifugal speed governor according to claim 2, in which said one end of said maximum fuel lever is pivotally connected to said second part of said holding lever.

5. A centrifugal speed governor according to claim 3, in which said compensating means is mounted on said control shaft for rotational and axial movement relative to said control shaft and further includes a stop means on said control shaft for limiting the axial movement of said compensating means on said control shaft in one direction, first and second members mounted on said control shaft for relative axial and rotational movement with respect to each other and to said control shaft, said compensating spring means comprising a compression spring member extending between said first and second members, said stop means being nearer to said first member than to said second member, and means for limiting the axial movement of said first and second members away from each other, said first part of said holding lever being in contact with the face of said second member axially opposite to said first member, the arrangement being such that said first and second members are spaced a distance by said compression spring member in said idle engine operating range, such that said first member is axially moved by said control shaft against the force of said compression spring member toward said second member in said compensation engine operating range and such that said first member is engaged by said second member when the engine speed is increased up to the high speed engine operating range.

6. A centrifugal speed governor according to claim 5, in which said main spring means is operatively associated with said second member so that said main spring means acts yieldably against the axial movement of said second member due to the axial movement of said control shaft and said first member in said high speed engine operating range.

7. A centrifugal speed governor according to claim 4, in which said compensating means is mounted on said control shaft for rotational and axial movement relative to said control shaft and further includes a stop means on said control shaft for limiting the axial movement of said compensating means on said control shaft in one direction, first and second members mounted on said control shaft for relative axial and rotational movement with respect to each other and to said control shaft, said compensating spring means comprising a compression spring member extending between said first and second members, said stop means being nearer to said first member than to said second member, and means for limiting the axial movement of said first and second members away from each other, said first part of said holding lever being in contact with the face of said second member axially opposite to said first member, the arrangement being such that said first and second members are spaced a distance by said compression spring member in said idle engine operating range, such that said first member is axially moved by said control shaft against the force of said compression spring member toward said second member in said compensation engine operating range and such that said first member is engaged by said second member when the engine speed is increased up to the high speed engine operating range.

8. A centrifugal speed governor according to claim 7, in which said main spring means has one end operatively associated with said second member so that said main spring means acts yieldably against the axial movement of said second member due to the axial movement of said control shaft and said first member in said high speed engine operating range, and in which said additional adjusting lever is associated with the other end of said main spring means.

9. A centrifugal speed governor according to claim 6, in which said control shaft has means thereon providing an annular surface extending radially outwardly from said control shaft and directed generally toward said fly weights, said maximum fuel lever having a roller rotatably mounted thereon at said third point and adapted to be brought into rolling contact with said annular surface when said stop means on said control shaft is moved into engagement with said first member of said compensating means.

10. A centrifugal speed governor according to claim 8, in which said control shaft has means thereon providing an annular surface extending radially outwardly from said control shaft and directed generally toward said fly weights, said maximum fuel lever having a roller rotatably mounted thereon at said third point and adapted to be brought into rolling contact with said annular surface when said stop means on said control shaft is moved into engagement with said first member of said compensating means.

* * * * *